United States Patent [19]

Shimada

[11] Patent Number: 4,946,299

[45] Date of Patent: Aug. 7, 1990

[54] DOCUMENT PROCESSING APPARATUS

[75] Inventor: Naoki Shimada, Tokyo, Japan

[73] Assignee: Canon Kabushiki Kaisha, Tokyo, Japan

[21] Appl. No.: 188,491

[22] Filed: Apr. 29, 1988

[30] Foreign Application Priority Data

May 13, 1987 [JP] Japan ..... 62-114799

[51] Int. Cl.[5] ..... B41J 19/32

[52] U.S. Cl. ..... 400/306; 400/65; 400/279; 400/900; 400/904; 400/705.5; 364/200; 364/225.7

[58] Field of Search ..... 400/2, 12, 65, 279, 400/283, 705.5, 303, 304, 306, 900, 904, 324; 364/200, 225.7

[56] References Cited

U.S. PATENT DOCUMENTS

| | | | |
|---|---|---|---|
| 4,074,798 | 2/1978 | Berger | 400/306 |
| 4,321,599 | 3/1982 | Yoshiba | 400/306 |
| 4,565,461 | 1/1986 | Vsui et al. | 400/65 |
| 4,615,631 | 10/1986 | Ueda | 400/279 |
| 4,624,591 | 11/1986 | Barnes et al. | 400/904 |
| 4,772,142 | 9/1988 | Makita | 400/303 |

FOREIGN PATENT DOCUMENTS

| | | | |
|---|---|---|---|
| 55275 | 4/1983 | Japan | 400/62 |
| 187573 | 9/1985 | Japan | 400/12 |
| 212358 | 10/1985 | Japan | 400/306 |
| 228157 | 11/1985 | Japan | 400/65 |
| 51353 | 3/1986 | Japan | 400/303 |

OTHER PUBLICATIONS

Adam et. al., "Lines Point & Tab Alignment", IBM Technical Disclosure Bulletin, vol. 25, No. 1, pp. 213-215, 6-82.

Yoshinaga, "Decision Method . . . ", IBM Technical Disclosure Bulletin, vol. 27, No. 9, pp. 5128-5129, 2-85.

*Primary Examiner*—Eugene H. Eickholt

*Attorney, Agent, or Firm*—Fitzpatrick, Cella, Harper & Scinto

[57] ABSTRACT

A document processing apparatus has a printer for printing characters; a keyboard used for inputting characters such as alphabetical characters, symbols and numerical characters; attribute imparting circuitry for imparting an attribute to characters input by the keyboard so as to vary the character spacing of the characters; and a pitch control circuit for varying the character pitch in accordance with the attribute imparted by the attribute imparting circuitry to cause the printer to print the characters at a varied character pitch. Accordingly, it is possible to print a numerical expression while providing suitable spacings between adjacent alphanumerical characters and between one or such characters and any adjacent symbol.

12 Claims, 14 Drawing Sheets

FIG. 5

| CHARACTERS HANDLED AS ALPHABETICAL CHARACTERS | | | | | | | | | | | | | |
|---|---|---|---|---|---|---|---|---|---|---|---|---|---|
| a | b | c | d | e | f | g | h | i | j | k | l | m | n |
| o | p | q | r | s | t | u | v | w | x | y | z | A | B |
| C | D | E | F | G | H | I | J | K | L | M | N | O | P |
| Q | R | S | T | U | V | W | X | Y | Z | ( | ) | [ | ] |
| { | } | 〔 | 〕 | | 。 | | | | | | | | |

FIG. 6

| CHARACTERS HANDLED AS SYMBOLS | | | | | | | | | | | | | |
|---|---|---|---|---|---|---|---|---|---|---|---|---|---|
| ! | ” | # | s | % | & | ’ | — | ‘ | ; | : | * | ? | < |
| > | ≦ | ≧ | ∫∫ | @ | ∞ | ∝ | ⋯ | ‥ | → | ← | ↑ | ↓ | ↗ |
| ↙ | ↖ | ↘ | — | + | − | ± | × | ÷ | = | ≠ | ≒ | ≡ | ∈ |
| ∋ | ⊆ | ⊇ | ⊃ | ∪ | ∩ | ∧ | ∨ | Å | ∫ | ℓ | ∀ | ∃ | ∠ |
| ⊥ | ∂ | $m^2$ | $m^3$ | ¢ | £ | § | ℃ | Λ | Γ | Θ | Ξ | Π | Σ |
| Φ | Ψ | Ω | α | β | γ | δ | ε | ζ | η | θ | ι | κ | λ |
| μ | ν | ξ | o | π | ρ | σ | τ | υ | φ | χ | ψ | ω | ~ |
| √ | 。 | , | . | · | 〃 | ▲ | | | | | | | |

FIG. 7

| | a | b | c | d | e | f | g | h | i | j | k | l | m | n | o | p | q | ] |
|---|---|---|---|---|---|---|---|---|---|---|---|---|---|---|---|---|---|---|
| a | 10 | 10 | 10 | 10 | 10 | 10 | 10 | 10 | 10 | 10 | 10 | 10 | 12 | 12 | 10 | 10 | 10 | 6 |
| b | 12 | 10 | 10 | 12 | 12 | 10 | 10 | 10 | 10 | 10 | 10 | 10 | 12 | 10 | 10 | 10 | 12 | 6 |
| c | 10 | 10 | 10 | 10 | 10 | 10 | 12 | 10 | 10 | 10 | 10 | 10 | 12 | 12 | 10 | 10 | 10 | 6 |
| d | 10 | 10 | 10 | 10 | 10 | 10 | 10 | 10 | 10 | 10 | 10 | 10 | 12 | 12 | 10 | 10 | 10 | 6 |
| e | 10 | 10 | 10 | 10 | 10 | 10 | 12 | 10 | 10 | 10 | 10 | 10 | 12 | 10 | 10 | 10 | 10 | 6 |
| f | 8 | 10 | 10 | 10 | 8 | 10 | 10 | 10 | 10 | 10 | 10 | 8 | 10 | 10 | 10 | 10 | 8 | 6 |
| g | 10 | 10 | 10 | 12 | 10 | 12 | 10 | 10 | 10 | 12 | 10 | 10 | 12 | 12 | 10 | 10 | 10 | 8 |

NOTE: 1) VERTICAL COLUMN: EACH CHARACTER LOCATED IMMEDIATELY BEFORE CORRESPONDING CHARACTER IN HORIZONTAL ROW (PARTIALLY LISTED).

2) HORIZONTAL ROW: EACH CHARACTER LOCATED IMMEDIATELY AFTER CORRESPONDING CHARACTER IN VERTICAL COLUMN (PARTIALLY LISTED).

3) UNIT: 1/120 INCHES.

4) CHARACTER PITCH: 10 PITCH.

FIG. 9(A)
$$\int \sin ax\,dx = -\frac{1}{a}\cos ax$$
90 92 91
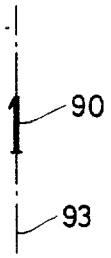
FIG. 9(B)
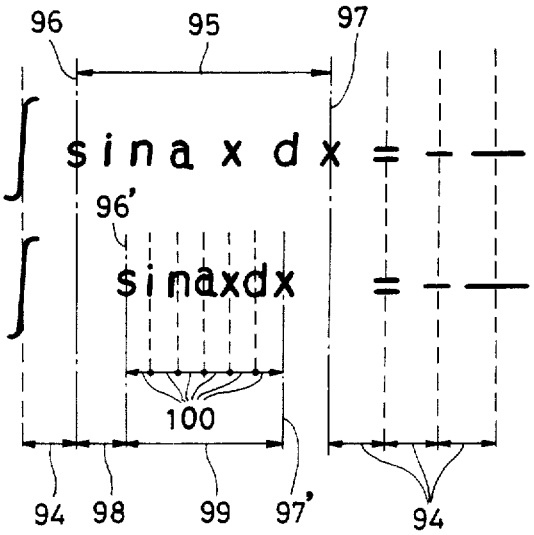
FIG. 9(C)

FIG. 10

$$\int \sin ax\,dx = -\frac{1}{a}\cos ax$$

$$\int \sin ax\,dx = -\frac{1}{a}\cos ax$$

FIG. 11

$$\int \sin ax\,dx = -\frac{1}{a}\cos ax$$

FIG. 12(A)

$$\int \sin ax\,dx = -\frac{1}{a}\cos ax$$

$$\int \sin ax\,dx = -\frac{1}{a}\cos ax$$

FIG. 12(B)

FIG. 13(A)

$$\int \sin ax\,dx = -\frac{1}{a}\cos ax$$

$$\int \sin ax\,dx = -\frac{1}{a}\cos ax$$

FIG. 13(B)

FIG. 14

$$\sin 3x = 3\sin x - 4\sin x$$

FIG. 15

$$\sin 3x = 3\sin x - 4\sin x$$

FIG. 16

$$\lim S_n = \sum a_n = S$$

DOCUMENT PROCESSING APPARATUS

BACKGROUND OF THE INVENTION

1. Field of the Invention

The present invention relates generally to document processing apparatus and, more particularly, to a document processing apparatus such as an electronic typewriter device arranged to store, print and display input characters.

2. Description of the Prior Art

In general, such a document processing apparatus is designed to formulate a document, and is also capable of formulating a numerical expression by a combination of various kinds of characters such as alphanumerical characters and symbols.

For the purpose of illustration, it will be considered how a conventional type of document processing apparatus is used to formulate the following numerical expression:

$$\lim_{n\to\infty} S_n = \sum_{n=1}^{\infty} a_n = S \tag{1}$$

In this numerical expression (1), "l", "i", "m", "S", "n" and "a" constitute a group of alphabetical characters, while "Σ", "∞", "→", and "=" constitute a group of symbols. (The following description is made aside from considerations as to the size of each character in a phrase, a sentence or a paragraph.) As is evident from the above example, almost all numerical expressions are represented by a combination of alphabetical characters and symbols or numerical characters.

Normally, a type wheel of a fixed pitch or a proportional pitch (hereinafter referred to as "PS pitch") can be used to print the numerical expression (1).

However, several problems are encountered when numerical expressions need to be readably printed.

By way of example, the following numerical expression will be considered:

$$\sin 3x = 3 \sin x - 4 \sin x \tag{2}$$

If a type wheel of a fixed pitch (for example, 10 pitch) is employed for printing, the expression (2) will be printed as shown in, for example, FIG. 14.

The printing shown in FIG. 14 will convey the impression that the expression (2) as a whole has been expanded between the leftmost character and the rightmost character since all the characters are widely spaced apart from one another. This is because, although the "sin" in the expression (2) originally constitutes one meaning by a combination of three characters, the characters "s", "i" and "n" as well as the remaining characters are printed with a substantially equal character spacing. For this reason, the impression conveyed by the individual characters "s", "i" and "n" is not associated by the reader with the true meaning of "sin" in the numerical expression. As a result, he may experience a sense of lack of understanding with respect to the whole of the printed numerical expression (2). In this case, it would be preferable for "s", "i" and "n", which mean "sine", and "c", "o" and "s" which mean "cosine" (although not contained in the numerical expression (2)) to be respectively printed with the spacing between each adjacent character being condensed.

The following is a description, referring to FIG. 15, of a case where the above noted numerical expression (2) is printed by means of a type wheel of a proportional pitch (PS pitch).

In the case of PS pitch, the numerical expression (2) is printed as shown in, for example, FIG. 15. The characters "s", "i" and "n" shown in FIG. 15 are closer to one another, and hence more visible, than those printed at a fixed pitch as shown in FIG. 14.

However, since the spacing between each adjacent character is narrow with respect to all the numerical characters, symbols and alphabetical characters, the numerical expression as a whole seems to be condensed.

When the previously-noted numerical expression (1) consisting of symbols and alphabetical characters is to be printed with PS pitch, it is condensed as shown in FIG. 16. As can be seen from FIG. 16, an imbalance occurs in the relative size of adjacent characters since "a" is extremely small in size compared with "Σ" which appears immediately before it.

In addition, symbols are in most cases printed using a type wheel of a fixed pitch. Accordingly, if printing is effected by a combination of a PS-pitch type wheel and a fixed-pitch type wheel, character spacings are often excessively widened or narrowed.

SUMMARY OF THE INVENTION

It is, therefore, a first object of the present invention to provide a document processing apparatus which is capable of adjusting character spacings to eliminate any sense of lack of clarity which may be conveyed by the way in which a whole numerical expression is printed, thereby enabling well-balanced printing of all the characters of the numerical expression.

It is a second object of the present invention to provide a document processing apparatus which is capable of outputting a numerical expression to be printed with a suitably adjusted character spacing between each adjacent character of the numerical expression.

To achieve these and other objects, the present invention provides a document processing apparatus comprising output means for outputting character information as characters; input means for inputting the character information representative of alphabetical characters, symbols and numerical characters; attribute information imparting means for imparting attribute information to particular character information representative of a predetermined string of characters input by the input means, the attribute information denoting a change in the character pitch of character information which constitutes the character string from the pitch of other character information; and pitch control means for changing the character pitch of the particular character information representative of the character string input by the input means on the basis of the attribute information imparted by the attribute information imparting means to cause the output means to output the particular character information and the other character information as characters at different character pitches.

Accordingly, it is possible to print a numerical expression while providing suitable spacings between adjacent alphanumerical characters and between one of such characters and its adjacent symbol.

BRIEF DESCRIPTION OF THE DRAWINGS

A better understanding of the present invention may be gained from the following detailed description, when read in connection with the accompanying drawings, in which:

FIG. 5 is a list showing characters handled as alphabetical characters in the embodiment;

FIG. 6 is a list showing characters handled as symbols in the embodiment;

FIG. 7 is a table showing relative character spacings for use in the embodiment;

FIGS. 9A, 9B and 9D are illustrations used to assist in explaining the centering printing operation effected in the embodiment;

FIG. 10 is an illustration of one example of an expression printed in accordance with the present invention;

FIG. 11 is an illustration of another example of an expression printed in accordance with the present invention;

FIGS. 12A and 12B are illustrations respectively showing in a comparative manner an example of an expression printed at a fixed pitch and an example of an expression printed in accordance with the embodiment of the present invention;

FIGS. 13A and 13B are illustrations respectively showing in a comparative manner an example of an expression printed at a fixed pitch and an example of an expression printed in accordance with another embodiment of the present invention;

FIG. 14 is an illustration of an example of an expression printed at 10 pitch which is a prior art fixed pitch;

FIG. 15 is an illustration of an example of an expression printed at a prior art PS pitch; and FIG. 16 is an illustration of another example of an expression printed in the prior art.

DESCRIPTION OF THE PREFERRED EMBODIMENTS

Preferred embodiments of the present invention will be described in detail below with reference to the accompanying drawings.

Basically, the present invention contemplates enabling the printing of a numerical expression while providing suitable spacings between adjacent alphanumerical characters and between one of such characters and its adjacent symbol, without recourse to a conventional method such as a method of uniformly enlarging character spacings or a method of reducing character spacings to such an extent that they do not overlap one another.

Figure 1:
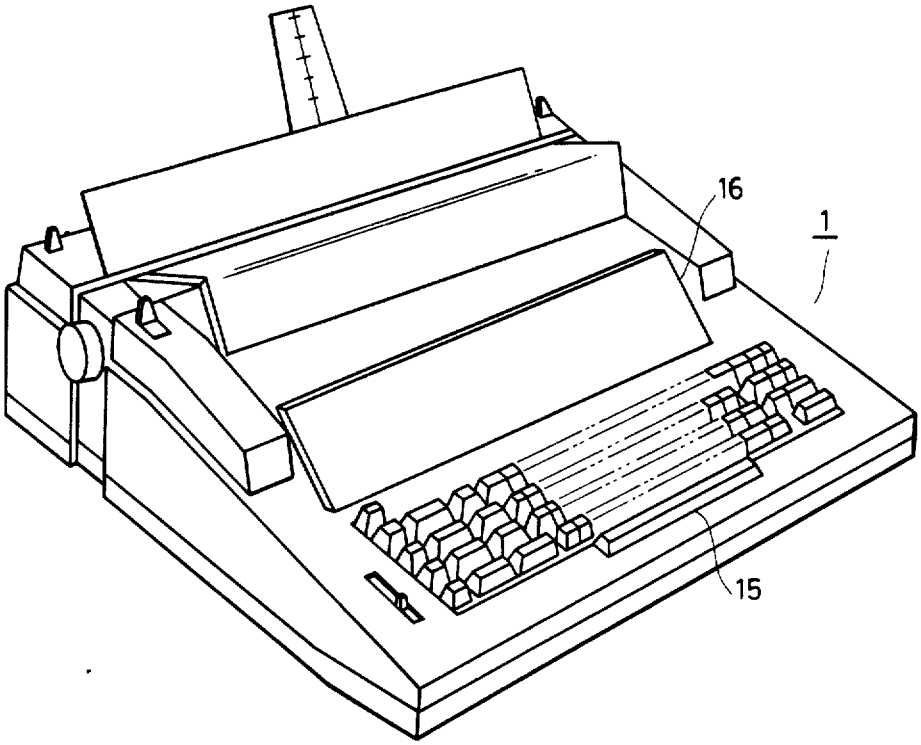
FIG. 1 is a diagrammatic perspective view illustrating an electronic typewriter device which is one example of document processing apparatus in accordance with the present invention.
Figure 2:
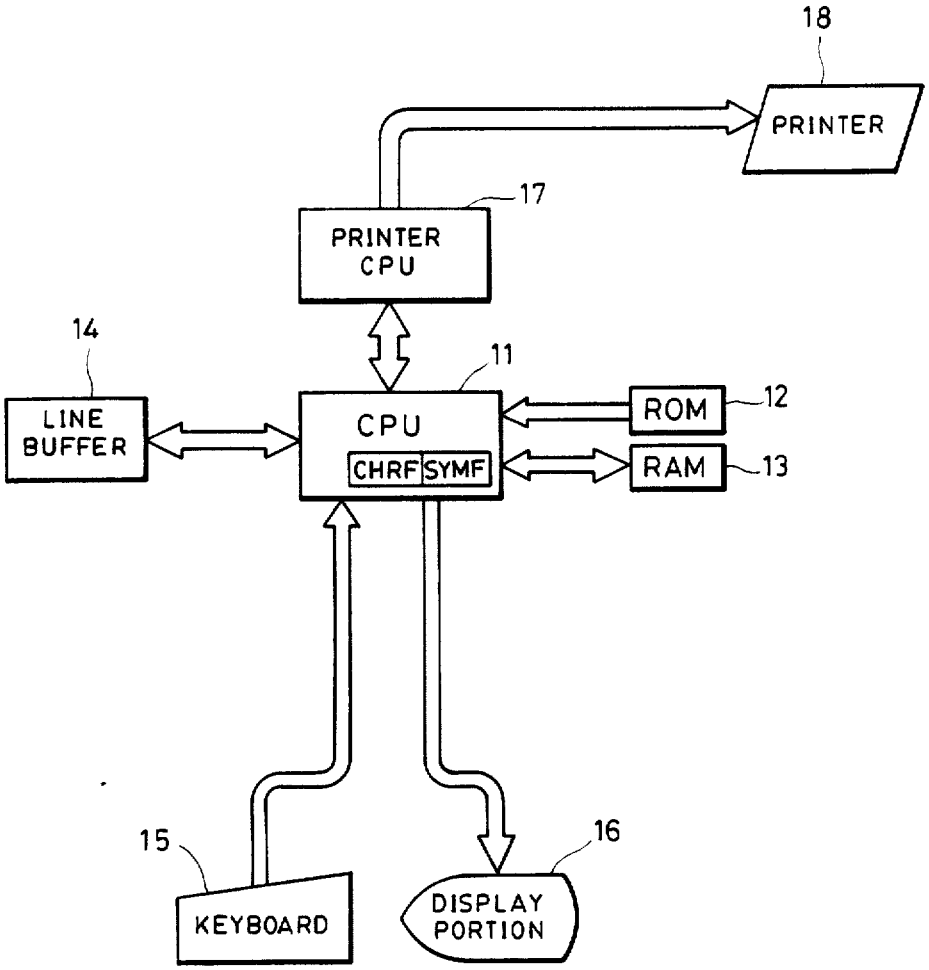
FIG. 2 is a block diagram of the electronic typewriter according to one embodiment of the present invention.

BASIC CONSTRUCTION (FIGS. 1 and 2)

FIG. 1 is a diagrammatic perspective view of the appearance of an electronic typewriter device which is an example of a document processing apparatus according to one embodiment of the present invention. FIG. 2 is a block diagram illustrating the basic construction of the electronic typewriter device shown in FIG. 1. By way of example, the following description of the presently preferred embodiment is directed to a particular type of electronic typewriter, but the present invention is not confined solely to the specific examples.

In FIG. 1, an electronic typewriter device is indicated generally at 1.

With reference to FIG. 2, the electronic typewriter device 1 includes the following major components: a CPU 11 for providing control over the entire device; a ROM 12 for storing various kinds of programs and predetermined constants (relative to character spacing; character width or the like); a RAM 13 capable of serving as a work area for reading or writing of data or of temporarily storing error information relative thereto by causing a program stored in the ROM 12 to run on the CPU 11; a line buffer 14 for temporarily storing characters equivalent to a maximum of one line in line printing mode; a keyboard 15 provided with various keys used for entering characters or symbols and for causing the CPU 11 to execute predetermined processes; a display portion 16 for providing a liquid crystal display of characters or symbols in accordance with a command supplied from the CPU 11; a printer CPU 17 responsive to a print signal from the CPU 11 for controlling a printer 18; and the printer 18 having a shift motor (not shown) for exchange of fonts, a magazine index (not shown) serving as the index of the fonts, and a wheel sensor and a wheel index for detecting the presence of a type wheel.

Figure 3:
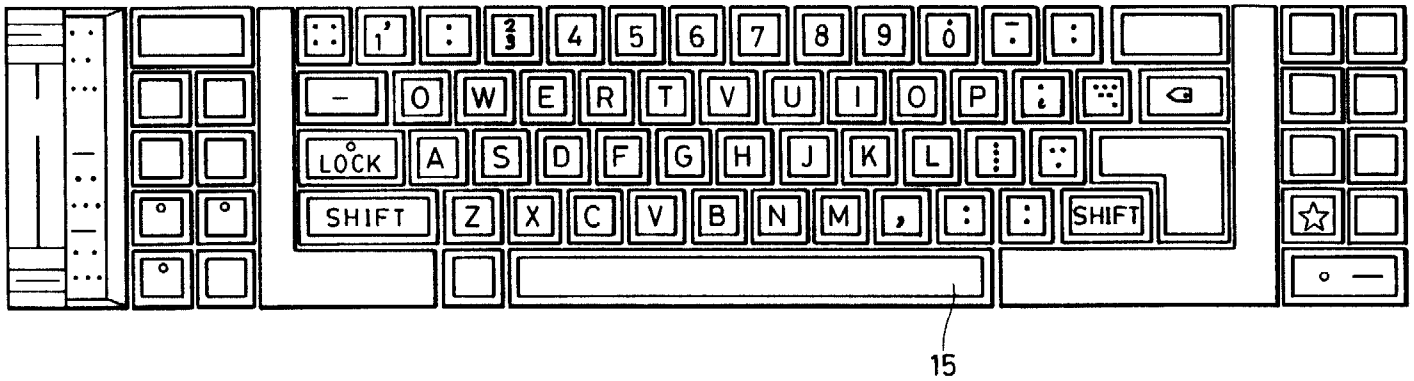
FIG. 3 is a top plan view of a keyboard for inputting alphanumerical characters used in the embodiment.
Figure 4:
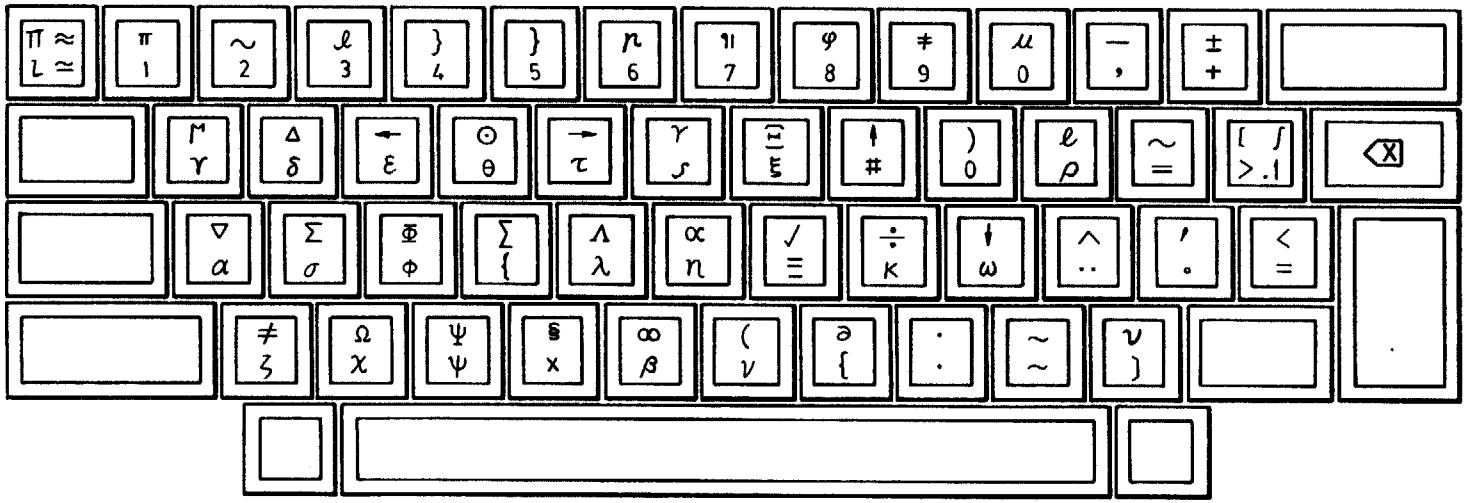
FIG. 4 is a top plan view of a keyboard for inputting symbols used in the embodiment.
Figure 8:
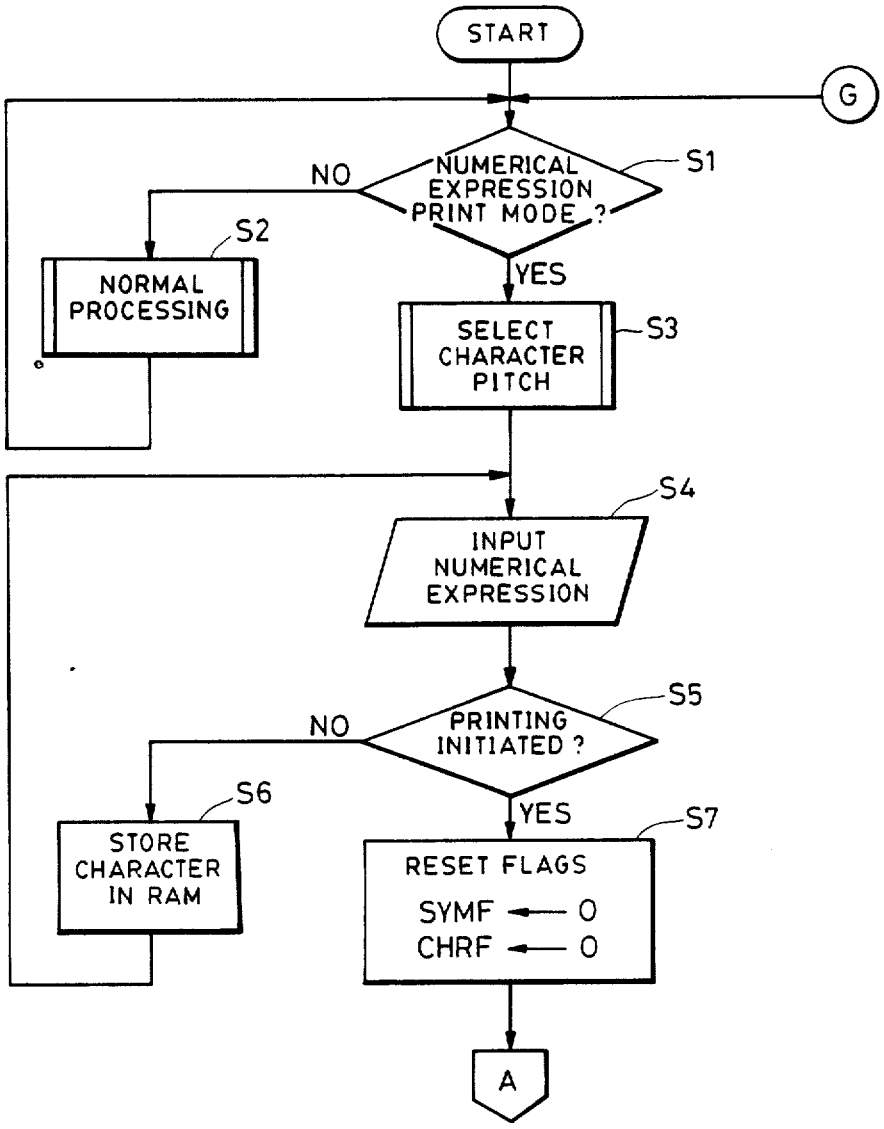
FIGS. 8A, 8B, 8C and 8D are flow charts illustrating the operation of the embodiment.
Figure 8:
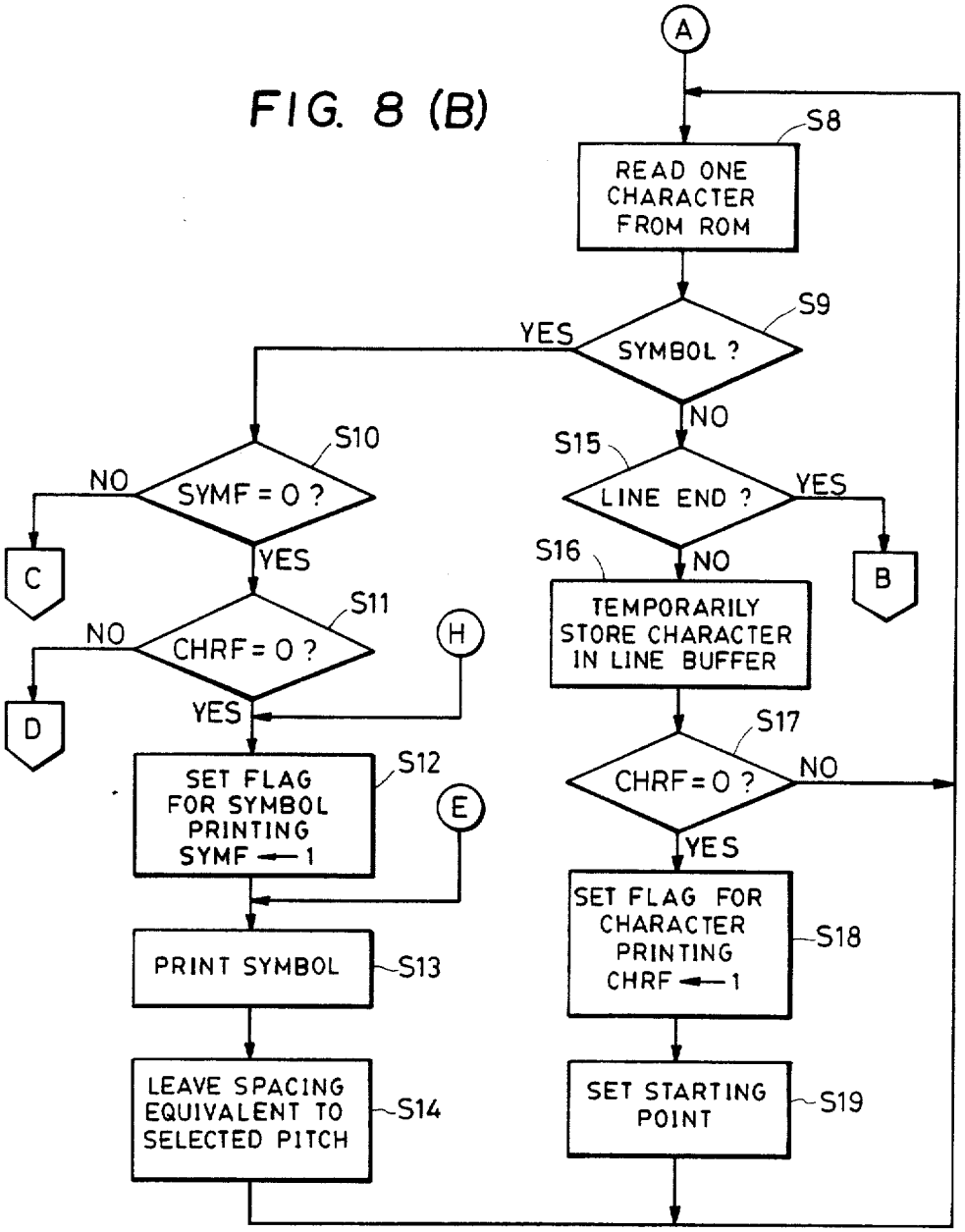
Figure 8:
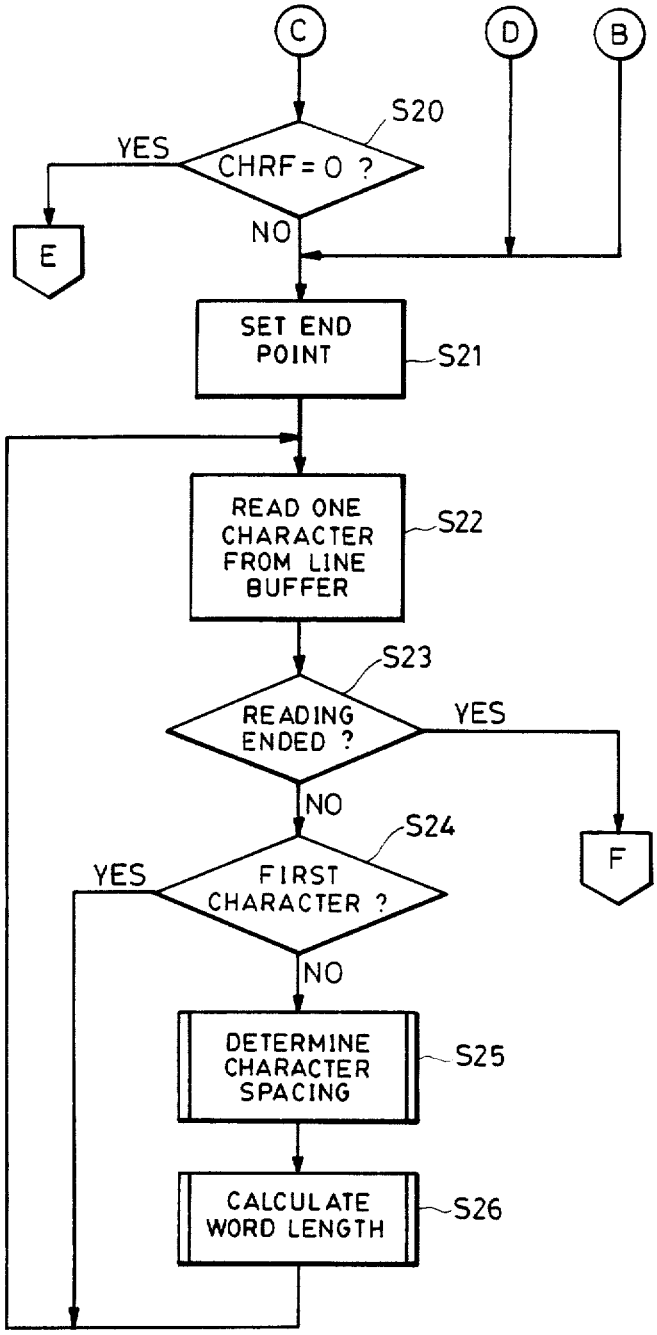
Figure 8:
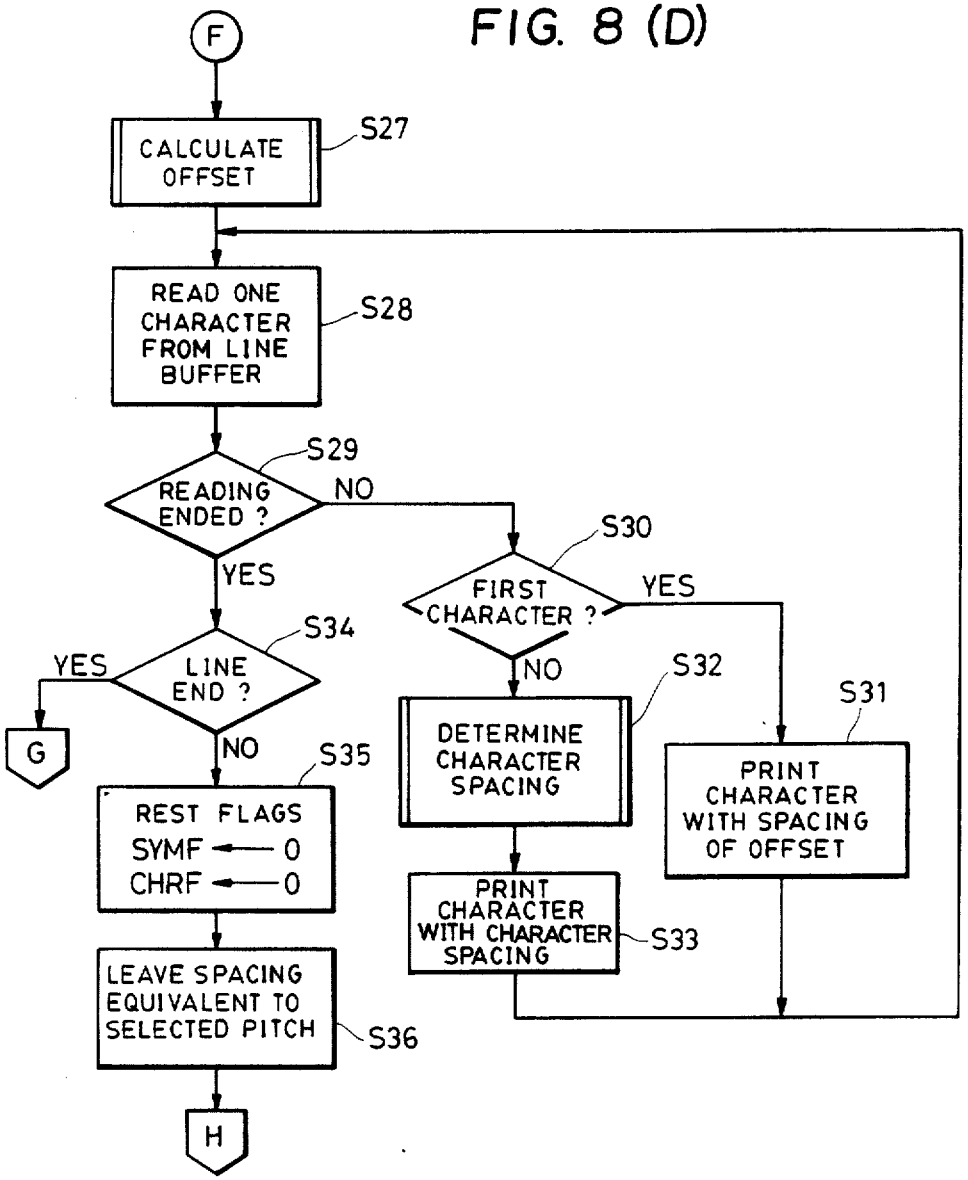

DIAGRAMMATIC DESCRIPTION OF PRINTING (FIGS. 3 and 4)

In printing characters, the keyboard 15 is employed which typically includes keys corresponding to alphanumeric characters as shown in FIG. 3. In printing symbols, a keyboard as shown in FIG. 4 may be separately prepared so that symbols can be entered without any special keyboard operations.

Also, the alphanumeric characters on the keys shown in FIG. 3 may be made to correspond to the symbols on the keys shown in FIG. 4 in a one-to-one relationship. Therefore, in practice, a single keyboard may be functionally used as these two keyboards. In this case, function keys and associated switches are operated to convert the keys between alphanumeric characters and special symbols.

The exchange of type wheels from alphanumeric characters to symbols is performed in the following manner. First, a signal representative of a symbol desired to be printed is transferred from the CPU 11 to the printer CPU 17 in which the signal is converted into a signal indicative of font exchange. The signal thus obtained is transferred to the printer 18. In this manner, a font dedicated for use in symbol printing is set in the printer 18 in accordance with the signal indicative of font exchange.

FIG. 5 illustrates characters handled as alphabetical characters, while FIG. 6 illustrates characters handled as symbols. If the function keys are operated, other special characters can be added to the list of symbols. Accordingly, the kinds of characters are not confined solely to those listed in FIGS. 5 and 6.

PROCESS FLOWS IN THE PRESENT EMBODIMENT (FIGS. 8A to 12)

First of all, the general flow of a normal processing will be described below.

Character information which is entered through the keyboard 15 is processed in the CPU 11, and then stored in RAM 13. At the time of printing, the CPU 11 reads the character information from the RAM 13, processes it into character information which can be printed, and transfers the processed character information to the printer CPU 17. The printer CPU 17 transfers this character information to the printer 18, and causes the printer 18 to effect printing. In this case, if a fixed pitch mode is selected, the CPU 11 reads from the ROM 12 information representative of how far the next character to be printed should be spaced from the character printed immediately before. On the other hand, if a PS pitch is selected, the CPU 11 reads from the ROM 14 information representative of a relative character spacing between a preceding character and the next character to be printed. Then, the CPU 11 determines a character spacing from the preceding character in accordance with one of the fixed and PS pitches and effects printing at the next print position that is spaced from the present print position by a distance equivalent to the thus-determined character spacing. The above-described operation is not applied to the printing of the first character in each line which is commonly printed on the left margin thereof.

Relative character spacings between the respective characters when printing is effected at the PS pitch are shown in FIG. 7 which is a table of relative character spacings between respective characters used as alphabetical characters. As a matter of course, if printing needs to be effected at another pitch (for example, at 12 pitch), another table of corresponding relative character spacings is prepared. Incidentally, the term "spacing" used herein means the spacing between the centers of adjacent printed characters.

The above-described normal basic operation of the embodiment of the document processing apparatus is hereinafter referred to as "normal processing".

The following is a description of the operation of the embodiment during printing of numerical expressions, taken in conjunction with the flow charts shown in FIGS. 8A to 8D.

A basic concept of the embodiment resides in the fact that, when a numerical expression is to be printed, a string of alphabetical characters sandwiched between symbols is condensed therebetween. In such printing, the spacing between the leftmost character in the alphabetical character string and its adjacent symbol is made substantially equal to that between the rightmost character in the same string and its symbol. Therefore, this printing is hereinafter referred to simply as "centering printing". Also, it is assumed herein that processings for printing are performed in units of lines. Accordingly, since characters corresponding to a denominator and a numerator as well as a horizontal line are printed vertically over three lines, it is assumed hereinafter that the numerator, the horizontal line, and the denominator are separately subjected to a processing for printing.

The operation of the presently preferred embodiment will be described below with reference to FIG. 9A, 9B and 9C, showing a numerical expression, and FIGS. 8A to 8D.

In FIG. 9A, reference numeral 90 denotes "1" in the first line, 91 "a" in the third line, and 92 "∫sinaxdx-=—— cosax" in the second line.

The basic feature of the present embodiment resides in the fact that at least one alphabetical character sandwiched between one symbol (or the beginning of a line) and another symbol (or the end of the line) is centered and printed between the symbols. Therefore, the second line will be first described as the most preferred example.

Referring now to FIG. 8A, when a numerical expression needs to be printed during normal processing, a numerical expression print mode is selected in Step S1, and the process proceeds to Step S3. On the other hand, when the normal processing is to be executed, the numerical expression print mode is not selected in Step S1, and the process proceeds to Step S2. In Step S3, a character pitch for printing is determined and, for example, 10 pitch or 12 pitch is selected. In the following description of the present embodiment, 10-pitch printing will be referred to by way of example. When a desired character pitch is determined, the process proceeds to Step S4, and input of the numerical expression to be printed is initiated. In Step S5, unless a line feed command is entered through a line feed key or a character of the numerical expression is entered at the end of the present line, printing is not initiated, and the process proceeds to Step S6 in which the characters of the numerical expression are stored in one-by-one fashion in the RAM 13 which serves as a memory device. In this manner, this process is repeated until "∫sinaxdx=——cosax" in the second line has been completely entered. Thereafter, when the feed line command is input through the line feed key, the printing of the numerical expression is initiated. Then, the process proceeds to Step S7 in which a character flag and a symbol flag are cleared to zero. The character flag (hereinafter referred to as "CHRF") indicates the attributes of alphabetical characters and numerical characters, while the symbol flag (hereinafter referred to as "SYMF") indicates the attributes of symbols.

In Step S8 shown in FIG. 8B, the first character "∫" in the second line is read from the RAM 13 which serves as a memory, and judgment is made in Step S9 with respect to whether or not the first character is a symbol. If it is determined in Step S9 that this character is a symbol (since, in this example, the character is a symbol), the process proceeds to Step S10 in which judgement is made with respect to whether or not the value of SYMF is "0". If the value of SYMF is "0", the process proceeds to Step S11 in which judgment is made with respect to whether or not the value of CHRF is "0". If the value of CHRF is "0", the process proceeds to Step S12.

FIG. 9C illustrates the character strings in the second line which are printed by two different methods. The upper character string is an example including symbols and alphabetical characters which are printed at a conventional fixed pitch. The lower character string is an example including symbols and alphabetical characters which are printed by the method of the preferred embodiment. The following description is made with reference to FIG. 9C as well as FIG. 8B.

The SYMF is set to "1" in Step S12 and, in Step S13, the symbol "∫" is printed at a location which corresponds to that at which printing is effected in normal processing. After the symbol has been printed, the process proceeds to Step S14 in which the print position is shifted at a normal pitch in order to print the next character. In FIG. 9C, spacings 94 are those of ten-pitch mode. Therefore, in this embodiment in which the ten pitch mode is selected by way of example, each spacing has a length equivalent to 1/10 inch.

When the symbol "∫" has been printed, the process returns to Step S8 in which "s", "i", "n", "a", "x", "d" and "x" are sequentially read from the RAM 13. First, the leftmost alphabetical character "s" in the second line is read out, and the process proceeds to Step S9 in which judgment is made with respect to whether or not the character read is a symbol. If the answer is "NO", the process proceeds to Step S15 in which judgment is made with respect to whether or not this character is located at the end of the present line. In this example, the above-noted characters "s", "i", "n", "a", "x", "d" and "x" are all alphabetical characters, and are not located at the end of the line. Accordingly, each of the characters is subjected to the same processing.

Since it is determined in Step S15 that the character "s" is not located at the end of the line, the process proceeds from Step S15 to Step S16 in which the characters are serially stored in the line buffer 14 in one-by-one fashion. In this example, a single character "s" is temporarily stored in the line buffer 14, and the process proceeds to Step S17 in which judgment is made with respect to whether or not the CHRF is set to "0". In this example, since "0" had already been set in the CHRF when the "s" was read, it is determined in Step S17 that the answer is "YES", and the process proceeds to Step S18. In Step 18 and the ensuing Step 19, an attribute is imparted to the leftmost character of a word including alphabetical characters and numerical characters. In this example, the CHRF is set to "1" in order to indicate the start of the word in Step S18 and, in Step S19, an attribute representative of the starting point of character printing (hereinafter referred to as "starting point") is imparted to the "s". The process returns to Step S8 in which the next "i" is read similarly to the "s", and Steps S9 to S17 are processed. Since the CHRF was set to "1" when the leftmost character was processed, the process returns from Step S17 directly to Step S8. In this manner, the process from Step S8 to S17 is repeated sequentially from "i" to "x".

When the symbol "=" following "x" is read, the process proceeds from Step S9 to Step S10 similarly to the symbol "∫". Since the SYMF has already been set to "1", the process jumps from Step S10 to Step S20 shown in FIG. 8C. In Step S20, judgment is made with respect to whether or not the CHRF is set to "0". Since the CHRF is already set to "1" at this point in time, it is determined that the answer is "NO". Then, the process proceeds to Step S21 in which an attribute representative of the end point of character printing (hereinafter referred to as "end point") is imparted to the alphabetical character "x" entered at the end of the word "sinaxdx".

In this fashion, the attributes representative of the starting point and end point of character printing are imparted respectively to the leftmost and rightmost characters of "sinaxdx" sandwiched between the symbols "∫" and "=".

Subsequently, in Steps S22 to S26, each character spacing between adjacent characters is determined with reference to the relative character spacing table shown in FIG. 7, and the thus-determined character spacings are sequentially added up to obtain a condensed word length between the character at the starting point and that at the end point. First, in Step S22, the leftmost character "s" is read from the line buffer 14 and, in Step S23, judgment is made with respect to whether or not all the characters have been read from the line buffer 14. In this example, the process proceeds to Step S24 until the rightmost "x" has been read. In Step S24, judgment is made with respect to whether or not the character read is the leftmost or first character. If the answer is "YES", in this example, if the character read is the leftmost character "s", the process returns to Step S22. On the other hand, if the answer is "NO", that is, if the character read is any one of those from the second character "i" to the rightmost character "x", the process proceeds from Step S24 to Step S25. In Step S25, each relative character spacing between adjacent characters is determined. More specifically, the relative character spacing between the character which was read from the line buffer 14 immediately before and the character which is presently being read is determined in accordance with the table shown in FIG. 7. In Step S26, the thus-determined relative character spacing is added to the current total, and the process returns to Step S22 in which the next character is read from the line buffer 14. This process continues until the reading of all the characters has been completed. The sum of the relative character spacings obtained when all the characters have been read is the condensed word length from the character at the starting point to that at the end point. In this embodiment, this condensed word length is referred to as a "centering word length". Furthermore, in Step S26, ten-pitch character spacings are added up independently of the relative character spacings shown in the table of FIG. 7 and thus the ten-pitch mode word length is obtained.

It is to be noted that, if it is determined in Step S24 that the character that has been read is the leftmost or first character, the centering word length and the ten-pitch mode word length are initialized to "0".

When all the characters have been read from the line buffer 14 in this fashion, the process proceeds to Step S27 shown in FIG. 8D. In Step S27, determination is made with respect to the starting point required to effect printing in accordance with the centering word length.

To determine the just-described starting point, it is necessary to calculate the distance between this starting point and the starting point when ten-pitch printing is effected. This distance is hereinafter referred to as an "offset". The offset is calculated using the following expression:

$$C = A/2 - B/2 \quad (3)$$

where A represents the ten-pitch mode word length, B represents the centering word length, and C represents the offset.

After the offset has been calculated using the expression (3), printing of the characters is initiated. First, in Step S28, the leftmost character "s" is again read from the line buffer 14, and the process proceeds to Step S29 in which judgment is made with respect to whether or not reading from the line buffer 14 has been completed. In this example, since the "s" is the leftmost or first character of the word "sinaxdx", that is, since reading has not yet been completed, the process proceeds to Step S30 in which judgment is made with respect to whether or not the relevant character is the first or leftmost character. When it is determined in Step S30 that the "s" is the first character, the process proceeds to Step S31 in which the character "s" is printed with a spacing equivalent to the offset. Subsequently, the process returns to Step S28, and the second character "i" is subjected to the processings from Step S28 to Step S30. (The process from Step S28 to Step S30 is repeated with respect to the second character "i" to the rightmost character "x".) Since the character "i" is not the first or leftmost character, the process proceeds from Step S30 to Step S32 in which a similar processing to that in the above-described Step S25 is effected, that is, the relative character spacing between the character which was printed immediately before and the next character to be printed is determined. In the following Step S33, the second character "i" is printed in accordance with the relative character spacing thus determined. Subsequently, this process is repeated until the remaining characters have been printed from "n" to "x".

When the rightmost character "x" is printed, that is, when all the characters have been read from the line buffer 14, the process proceeds from Step S28 through Step S29 to Step S34 in which judgment is made with respect to whether or not the character "x" is printed at the end of the line. In this example, since the position at which the "x" was printed is not the end of the line, the process proceeds to Step S35 in which SYMF and CHRF are both reset to "0" since the character to be printed next to the alphabetical character "x" along the same line is the symbol "=". In Step S36, the next print position is located at a position which is spaced from the rightmost character "x" in the line with one spacing at 10 pitch, which was set in Step S3. The thus-spaced position is rendered as the print position for the next symbol "=". The process then returns from Step S36 to Step S12 shown in FIG. 8B, and Steps S12 to S14 are again processed.

In the illustrated numerical expression, the symbol "=" is also followed by the symbols "−" and "—" along the second line. The process proceeds from Step S8 through Steps S9 and S10 to Step S20 in FIG. 8C to Step S13 in FIG. 8B in which it is determined that the character to be printed next to the symbol "=" is a symbol. Therefore, the process further proceeds from Step S20 through Step S13 to Step S14 in which the symbol "−" is printed. Subsequently, the next symbol "—" is printed by a similar processing.

In FIG. 9C, reference numeral 95 represents the ten-pitch mode word length; 96 and 96′ the starting points; 97 and 97′ the end points; 98 the offset; 99 the centering word length; and 100 the relative character spacings. When compared with the upper character strings printed at ten pitch, it will be understood that, in the lower character strings printed in accordance with this invention, the symbols can be readily distinguished from the alphabetical characters.

By way of example, the above description refers to the procedures in which the alphabetical characters "sinaxdx" between the starting point 96 and the end point 97 are processed by the centering printing. If a plurality of characters are to be printed as in this example, they are printed sequentially in one-by-one fashion so that each spacing between adjacent ones may become the relative character spacing 100 as shown in FIG. 9C in accordance with the table in FIG. 7. When the printing of all the alphabetical characters has been completed, the next symbol is printed at a location which is spaced from the last alphabetical character by a distance equivalent to one spacing at ten pitch. If that symbol is followed by further symbols, they are printed with spacings of ten pitch. This fixed-pitch printing of symbols provides the visual effect of enabling symbols to be represented in a mutually separate manner.

The following is a description of printing of the characters in the first and third lines shown in FIG. 9A.

Referring to FIG. 8A, conversion from normal processing to numerical expression print mode as well as selection from character pitches are identical to those when the characters in the second line are printed. The process proceeds to Step S4 in which the numerical character "1" in the first line is stored in the memory or RAM 13. Since the input character is a single numerical character "1", printing is initiated in Step S5. A signal indicative of the initiation of printing is transferred to the CPU 11 by depressing the line feed key after the numerical character "1" has been entered by key operation. In Step S7, the CPU 11 clears CHRF and SYMF to zero.

After this flag resetting has been executed, the process proceeds to Step S8 shown in FIG. 8B in which one character is read from the memory or RAM 13 (in this example, the numerical character "1" in the first line). Then, judgment is made in Step S9 with respect to whether or not the first or leftmost character is a symbol. Since the character that was read is a numerical character, the process proceeds to Step S15 in which judgment is made with respect to whether or not the numerical character "1" is located at the end of a line. In this example, it is determined in Step S15 that the numerical character "1" is not located at the end of the line, and the process proceeds to Step S16 in which the numerical character "1" is stored in the line buffer 14. Then, judgment is made in Step S17 with respect to whether or not the value of CHRF is zero. Since CHRF has already been cleared to zero, the numerical character "1" has not yet been provided with any attributes it would require as a character. Therefore, the process proceeds to Step S18 in which the relevant attribute (CHRF="1") is imparted to the numerical character "1". After the attribute has been imparted, the starting point which is an attribute indicative of the leftmost character to be printed is also imparted to the numerical character "1". In this manner, the process proceeds to Step S19, and then returns to Step S8.

When the second character (or the line feed key input) is read from the memory or RAM 13 in Step S8, the process proceeds through Step S9 to Step S15. Since it is now determined in Step S15 that this character is located at the end of the first line, the process jumps to Step S21 shown in FIG. 8C. In Step S21, an attribute representative of the end point is imparted to the numerical character "1". In this example, however, the numerical character "1" has already been provided with the attribute indicative of the starting point. Therefore, the numerical character "1" is provided with the attributes of both the starting point and the end point.

This status is illustrated in FIG. 9B in which a center line 93 passing through the axis of the numerical character "1" is a line consisting of the starting and end points.

Referring back to FIG. 8C, in Step S22, a single character is read out of the characters temporarily stored in the line buffer 14. However, since the numerical character "1" is the first one, it is unnecessary to calculate the relative character spacing from a preceding character. Therefore, the process proceeds from Step S23 to Step S24 and returns to Step S22. In the processing of the first line, since the single numerical character "1" is stored in the line buffer 14, no other character is read and it is therefore determined in Step S23 that reading from the line buffer 14 has been completed. Then, the process proceeds to Step S27 in which the offset is calculated. In the character printing of this example, a word length of 10-pitch mode is needed as a parameter. However, since the numerical character "1" represents both the leftmost and rightmost characters, no word length is generated and thus the ten-pitch mode word length is held in its initial state "0". Similarly, the centering word length goes to "0". When one character is read from the line buffer 14 in Step S18, the process proceeds through Step S29 to Step S30. Since the numerical character "1" is the first or leftmost character, the process proceeds from Step S30 to Step S31 in which the first line is printed with an offset of "0". After the first line has been printed, the process returns from Step S31 to Step S28 and again proceeds to Step S29 in which judgment is made with respect to whether character reading has ended. In this example, since only the single numerical character "1" is printed, it is determined in Step S29 that character reading has ended, and the process proceeds to Step S34. Since the numerical character "1" is followed by the end of the first line, the process returns from Step S34 to the initial Step S1 shown in FIG. 8A. Although the "1" in the first line is printed by centering printing between the starting point and the end point, the print position of the "1" nevertheless coincides with a print position when it is not processed by centering printing, that is, a position at which the starting point is the same as the end point.

The alphabetical character "a" in the third line is also printed at a print position at which its starting and end points are the same, by a similar processing to that of the numerical character "1" in the first line.

In this manner, as shown in FIG. 10, the portion of the numerical expression shown in FIG. 9A between the symbols "∫" and "=" is condensed, and the alphabetical characters "cosax" following the symbol "−" are printed by centering printing between the symbol "−" and the line-feed symbol or the line-ending symbol which is input following the rightmost character "x".

With reference to FIG. 12A and 12B, an example printed by the present method will be explained. FIG. 12A shows an example printed at the prior art fixed pitch, with FIG. 12B showing an example printed by the method of the above-described embodiment. As compared with the example of FIG. 12A, it seems that each character string in that of FIG. 12B is combined into one unit since the characters "sinaxdx" and "cosax" are condensed. Also, in this embodiment, when a numerical expression is to be printed, only alphabetical characters are moved along a line. Therefore, when a fraction such as "1/a" is to be printed, the symbol "−", the numerical character "1" and the alphabetical character "a" are printed without their respective relative print positions being changed. Accordingly, the positional relationships between the denominator, the numerator and the horizontal line are not changed by centering printing, and the respective print positions do not deviate from each other.

OTHER EMBODIMENTS (FIGS. 11, 13A and 13B)

As another embodiment, the above-described numerical expression may be printed in such a manner that each group of characters having an independent meaning is spaced from the adjacent group. FIGS. 13A and 13B are views illustrating a method of printing a numerical expression as shown in FIG. 11. In this embodiment, the key words such as "sin", "cos" and "ax" in the numerical expression shown in FIG. 13A are handled as symbols (a plurality of characters are collectively processed as a single symbol). These symbols including a plurality of characters are printed in accordance with the character spacings shown in the relative character spacing table shown in FIG. 7. However, the character string "sinax", for example, would be separated into two symbols "sin" and "ax" and the symbols thus separated are individually processed. In consequence, the "sin" is suitably spaced from the "ax" as shown in FIG. 13B (FIG. 11), and this makes the numerical expression easy to read and hence readily understood.

In yet another embodiment, the character spacing between two adjacent characters may be calculated from the character widths of the adjacent characters so that they do not overlap each other, without use of the relative character spacing shown in FIG. 7. For example, successive characters may be printed with a character spacing equivalent to (the width of a character printed immediately before)/2+ (the width of the next character to be printed)/2. If similar alphabetical characters such as "M"s are printed adjacent to each other, a slight spacing may preferably be formed therebetween.

It will be appreciated from the foregoing that, in accordance with the present invention, it is possible to provide a document processing apparatus capable of printing characters with balanced character spacings so as to enable a reader to smoothly grasp the meaning of a numerical expression.

The present invention is not limited solely to line printing. For example, line buffers for storing a plurality of lines of characters may be incorporated so that the numerical expression print mode or the normal document processing mode can be set for each line at the top thereof, printing being effected in accordance with the mode set for each line. In addition, an attribute representative of the numerical expression print mode may be imparted to a character string which constitutes a numerical expression, instead of to an entire line. In printing, a line buffer may be made to store a character string that includes the character immediately before the cancel position of the numerical expression print mode, and the previously-described printing may then be effected. In this case, it is of course possible to change modes for each character.

Accordingly, it will be understood from the foregoing that, in accordance with the present invention, it is possible to provide a document processing apparatus which is capable of printing characters while distinguishing between symbols and other characters so that the meaning of a numerical expression to be printed can be readily grasped by the reader, as well as to provide such an apparatus that is capable of printing characters with balanced character spacings.

What is claimed is:

1. A document processing apparatus comprising:

input means for inputting particular character information and other character information, wherein said other character information is representative of alphabetical characters, symbols and numerical characters, and wherein said particular character information is representative of a predetermined string of characters;

output means for outputting said particular and other character information as said alphabetical and numerical characters and said symbols, wherein said output means is adapted to output said particular and other character information at different character pitches;

attribute information imparting means for automatically imparting attribute information to said particular character information representative of said predetermined string of characters input by said input means, said attribute information denoting a change in the character pitch of said particular character information, which is representative of said predetermined string of characters from the pitch of said other character information; and pitch control means for changing the character pitch of said particular character information representative of said predetermined string of characters input by said input means on the basis of said attribute information imparted by said attribute information imparting means to cause said output means to output said particular character information and said other character information as characters at different character pitches.

2. A document processing apparatus according to claim 1, wherein said output means is a printer.

3. A document processing apparatus according to claim 1, further comprising memory means for storing said particular character information representative of said character string to which said attribute information is imparted by said attribute information imparting means.

4. A document processing apparatus according to claim 1, wherein said output means automatically outputs said particular and other character information as said alphabetical and numerical characters and said symbols, and wherein said pitch control means automatically changes the character pitch of the said particular character information representative of said predetermined string of characters input by said input means, on the basis of said attribute information imparted by said attribute information imparting means to cause said output means to automatically output said particular character information and said other character information as characters at different character pitches.

5. A document processing apparatus comprising:

input means for inputting character information representative of alphabetical characters, symbols and numerical characters, and particular character information representative of a numerical expression comprising symbols and characters;

output means for outputting said character information and said particular character information as said alphabetical and numerical characters and symbols;

expression attribute imparting means for automatically imparting attribute information to said particular character information, representative of said numerical expression input by said input means; said attribute information denoting a change in the character of said particular character information which represents said numerical expression; and pitch control means for discriminating said attribute information, which said expression attribute imparting means imparts to said particular character information representative of said numerical expression, to enlarge the character pitch between any character information representing said symbols and any character information adjacent said symbols in said numerical expression represented by said particular character information, and thereby for causing said output means to output said particular character information representative of said numerical expression at said changed character pitch.

6. A document processing apparatus according to claim 5, wherein said output means is a printer.

7. A document processing apparatus according to claim 5, further comprising memory means for storing said particular character information constituting said numerical expression to which said attribute information is imparted by said expression attribute information imparting means.

8. A document processing apparatus according to claim 5, wherein said output means automatically outputs said character information and said particular character information as said alphabetical and numerical characters and symbols, and wherein said pitch control means automatically discriminates said attribute information, which said expression attribute imparting means imparts to said particular character information representative of said numerical expression, to automatically enlarge the character pitch between any character information representing said symbols and any character information adjacent to said symbols in said numerical expression represented by said particular character information, and thereby for automatically causing said output means to automatically output said particular character information representative of said numerical expression at said changed character pitch.

9. A document processing apparatus comprising:

input means for inputting said character information representative of alphabetical characters, symbols and numerical characters and particular character information representative of a numerical expression comprising symbols and character string information sandwiched between sets of character information representing symbols;

output means for outputting said character information and said particular character information as said alphabetical and numerical characters and symbols;

expression attribute imparting means for automatically imparting attribute information to said particular character information representative of said numerical expression input by said input means, said attribute information denoting a change in the character pitch of said particular character information which represents said numerical expression; and means for discriminating said attribute information, which said expression attribute imparting means imparts to said particular character information representative of said numerical expression, to reduce the character pitch of said character string information sandwiched between said sets of character information representing said symbols, and thereby for causing said output means to output said particular character information representative of said numerical expression at said changed pitch.

10. A document processing apparatus according to claim 9, wherein said output means is a printer.

11. A document processing apparatus according to claim 9, further comprising memory means for storing said particular character information constituting said numerical expression to which said attribute information is imparted by said expression attribute information imparting means.

12. A document processing apparatus according to claim 9, wherein said output means automatically outputs said character information and said particular character information as said alphabetical and numerical characters and symbols, and wherein said discriminating means automatically discriminates said attribute information, which said expression attribute imparting means imparts to said particular character information representative of said numerical expression, to automatically reduce the character pitch of said character string information sandwiched between said sets of character information representing said symbols, and thereby automatically causing said output means to output said particular character information representative of said numerical expression at said changed pitch.

* * * * *

UNITED STATES PATENT AND TRADEMARK OFFICE

CERTIFICATE OF CORRECTION

PATENT NO. : 4,946,299

DATED : August 7, 1990

INVENTOR(S) : Naoki Shimada

It is certified that error appears in the above-identified patent and that said Letters Patent is hereby corrected as shown below:

ON THE TITLE PAGE

[56] References Cited:

Under "U.S. PATENT DOCUMENTS":

"Vsui et al." should read --Usui et al.--.

Under "OTHER PUBLICATIONS":

"Lines" should read --Line,--.

[57] ABSTRACT:

Line 15, "or" should read --of--.

COLUMN 13:

Line 52, "character" (first occurrence) should read --character pitch--.

Signed and Sealed this

Ninth Day of June, 1992

*Attest:*

*Attesting Officer*

DOUGLAS B. COMER

*Acting Commissioner of Patents and Trademarks*